United States Patent [19]

Hartline

[11] Patent Number: 4,861,101

[45] Date of Patent: Aug. 29, 1989

[54] SOFA OTTOMAN

[75] Inventor: Michael F. Hartline, Saltillo, Miss.

[73] Assignee: Super Sagless Corp., Tupelo, Miss.

[21] Appl. No.: 187,232

[22] Filed: Apr. 28, 1988

[51] Int. Cl.[4] ..... A47C 1/02

[52] U.S. Cl. ..... 297/69; 297/85; 297/429; 297/434

[58] Field of Search ..... 297/429, 434, 69, 85

[56] References Cited

U.S. PATENT DOCUMENTS

| | | | |
|---|---|---|---|
| 3,099,487 | 7/1963 | Knabusch et al. | 297/429 |
| 3,730,585 | 5/1973 | Rogers, Jr. et al. | 297/85 |
| 4,108,491 | 8/1978 | Rogers, Jr. | 297/85 |
| 4,113,305 | 9/1978 | Hampton | 297/69 |
| 4,477,118 | 10/1984 | Ruble | 297/85 |

FOREIGN PATENT DOCUMENTS

| | | | |
|---|---|---|---|
| 803673 | 10/1958 | United Kingdom | 297/85 |

*Primary Examiner*—Francis K. Zugel

*Attorney, Agent, or Firm*—Wolf, Greenfield & Sacks

[57] ABSTRACT

A sofa ottoman assembly includes a lazy tong linkage having a bracket at one end which is connected to the front rail of the sofa on which the assembly is installed and a second bracket which supports the ottoman. An actuating assembly includes a handle to be mounted on the side rail of the sofa and a number of links and levers connected between the handle and the lazy tong linkage which enables the party seated on the sofa to extend and retract the ottoman. The lazy tong linkage has a narrow side profile so as not to significantly increase the front to back dimension of the sofa on which it is mounted, and the actuating assembly is disposed closely adjacent the side rail of the sofa frame so as not to subtract from the space for a folding bed frame and mattress within the sofa frame.

9 Claims, 5 Drawing Sheets

SOFA OTTOMAN

INTRODUCTION

This invention relates to sofas and more particularly comprises a sofa with an ottoman assembly.

Heretofore, no commercially successful one-piece sofas have appeared on the market which include an ottoman assembly. The failure of the furniture industry to offer such a product at least in part is due to the difficulty in incorporating an ottoman assembly into a sofa without increasing the depth of the sofa to unacceptable limits.

The furniture market suggests that sofa ottomans are particularly applicable to sofa beds where some styling may be sacrificed for increased furniture versatility. Incorporating an ottoman assembly into a sofa bed is further complicated by the lack of room within the sofa frame for storing the ottoman in a retracted position. There is also very little room available to store the ottoman on the outside of the front rail of the frame because conventional folding bed frames employed in sofa beds have legs that extend from the bed frame to the floor very closely adjacent the front rail when the bed is open.

The principal object of the present invention is to provide an ottoman assembly having a very narrow fore and aft profile when in the collapsed state so as to minimize the space required for the assembly when the ottoman is retracted.

Another important object of this invention is to provide an ottoman assembly specifically designed for use on sofas, and which may be mounted on the outside of the front rail of the sofa frame.

Yet another important object of this invention is to provide an ottoman assembly suitable for use on sofas, which requires very limited space within the sofa frame.

To accomplish these and other objects, the ottoman assembly of the present invention includes a lazy tong linkage mechanism wherein all of the lazy tong links are disposed in separate planes perpendicular to the front rail of the sofa and are mounted on a bracket secured to the outer surface of the sofa front rail. The arrangement of the lazy tong links in separate planes enables them to be collapsed so as to provide a profile which is essentially the width of a single link in the mechanism. The lazy tong linkage mechanism is driven by an actuating assembly that includes a handle mounted on the outside of the arm side rails on a shaft that passes through the arm. The shaft in turn is connected to the lazy tong mechanism by a minimum number of links which lie closely adjacent to the inside of the sofa side rail and within the arm cavity. Therefore, very little space is consumed by the actuating assembly, and it will not interfere with a folding bed frame which may be mounted in the sofa to form a sofa bed.

These and other objects and features of the present invention will be better understood and appreciated from the following detailed description of one embodiment thereof, selected for purposes of illustration and shown in the accompanying drawings.

BRIEF FIGURE DESCRIPTION

DETAILED DESCRIPTION

Figure 1:
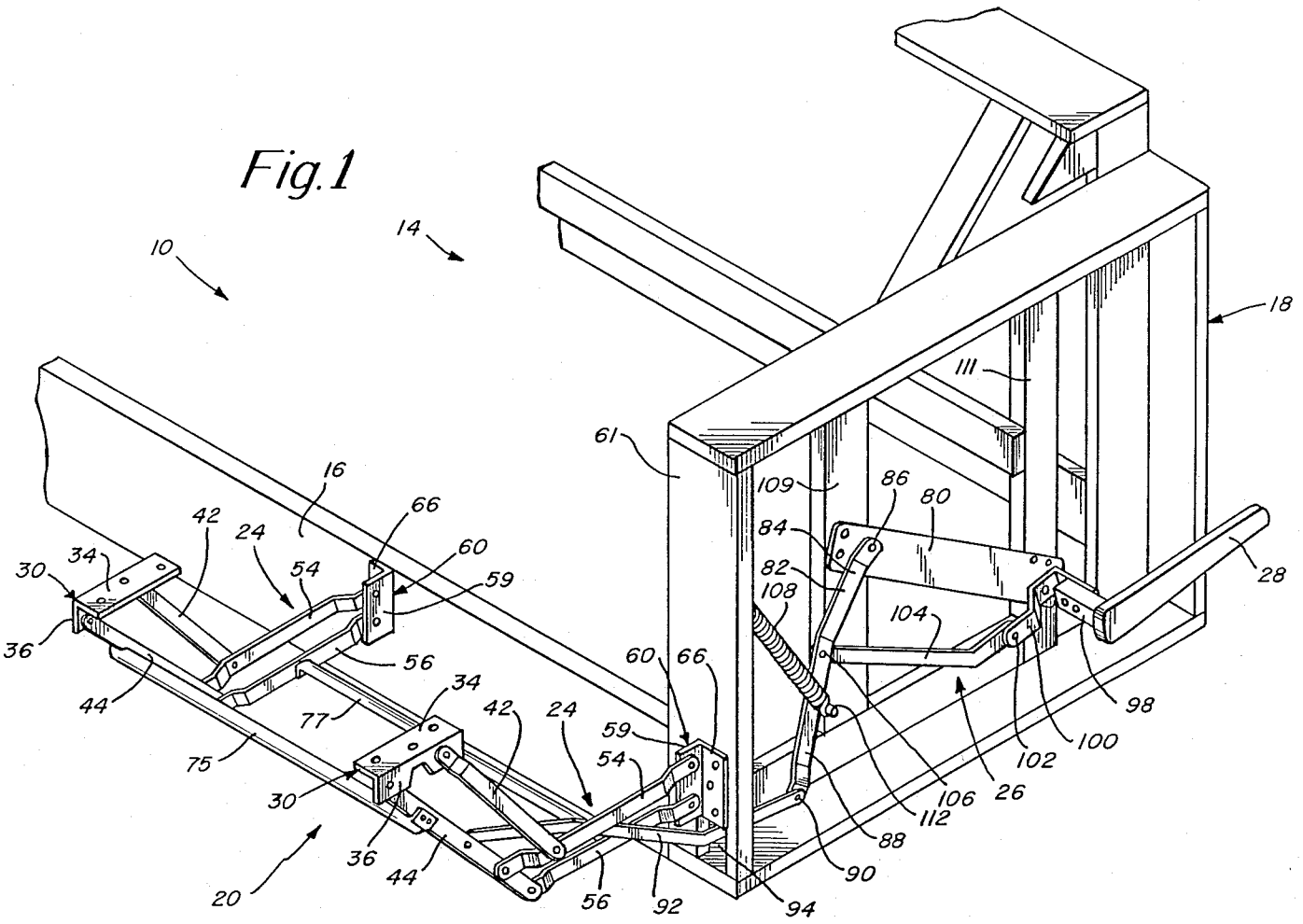
FIG. 1 is a fragmentary perspective view of a sofa frame incorporating the ottoman assembly of the present invention.

In the drawing, a sofa 10 is suggested having a seat cushion 12 disposed within the frame 14. The frame includes a front rail 16 oriented in a vertical plane and which extends between the side frames 18 of the sofa, which define the sofa arms. An ottoman assembly 20 is provided as part of the sofa. In the embodiment shown, the ottoman assembly is associated with just one side of the sofa and is not intended to serve those seated in the middle or other side of the sofa. Separate ottoman assemblies may, of course, be provided at each end of the sofa if desired.

The ottoman assembly 20 includes an ottoman 22, a pair of lazy tong linkage mechanisms 24, and an actuating lever assembly 26 which includes a handle 28. Because the two lazy tong linkage mechanisms 24 employed to support the ottoman 22 are mirror images of one another, only one is described. They are connected to the back of the ottoman 22 adjacent its opposite ends. It should be noted in FIG. 2 that the lazy tong mechanism 24 has a very small front to rear profile when the ottoman is retracted so as not to add significantly to the depth of the sofa nor to project forwardly much beyond the front rail 16.

Ottoman 22 which typically may be upholstered and covered with a fabric that matches the fabric of the sofa is supported on a pair of brackets 30 secured to the ottoman back 32. The bracket 30 includes a plate 34 secured to the back face of the ottoman and a flange 36 which is perpendicular to plate 34. For purposes of reference, hereinafter end 38 of the ottoman 22 will be identified as the top end thereof and the other end 40 of the ottoman will be identified as its lower or bottom end. The corresponding ends of the bracket 30 and its flange 36 will be similarly identified.

The upper end of the flange 36 is connected to lever 42 of the lazy tong mechanism 24, and the lower end of the flange 36 is connected to lazy tong lever 44. The levers 42 and 44 are connected on opposite faces of the flange 36 by rivet pivots 46 and 48, respectively. As is evident in FIG. 4, the upper end **42*a* of lever 42 is offset from the plane of the major length of that lever and the levers 42 and 44 therefore are disposed in separate and spaced apart parallel planes. The levers 42 and 44 are connected at their other ends by pivot rivets 50 and 52, to a second pair of levers 54 and 56, respectively. The major lengths of levers 54 and 56 are also disposed in separate and spaced apart parallel planes which are also parallel to and spaced from the planes of the levers 42 and 44. The lower end 56*a* of the lever 56 is offset to prevent interference with the lever 44. Adjacent the pivot rivet 52, the offset lower end 54*a* of lever 54 is also connected by pivot rivet 58 to lever 44. The two pairs of levers 42, 44 and 54, 56 operate when actuated to elevate and retract the ottoman 22**.

The offset rear or upper ends 54*b* and 56*b* of the levers 54 and 56 are connected to the flange 59 of mounting bracket 60, which in turn is connected to the front rail 16 of the sofa. In FIG. 1, the nearer bracket 60 is shown connected to the front face of vertical arm rail 61 which is coplanar with the front rail 16. In this description, the arm rail 61 is considered part of the front rail 16. Pivot rivets 62 and 64 connect the levers 54 and 56 to the flange 59 while plate 66 of bracket 60 (see FIGS. 1 and 4) is connected to the front face of rail 16. It will be noted in FIG. 4 that mounting holes 68 are provided in the plate 66 to secure bracket 60 to rail 16, and similar holes 70 in the plate 34 are provided to secure the bracket 30 to the ottoman.

Figure 5:
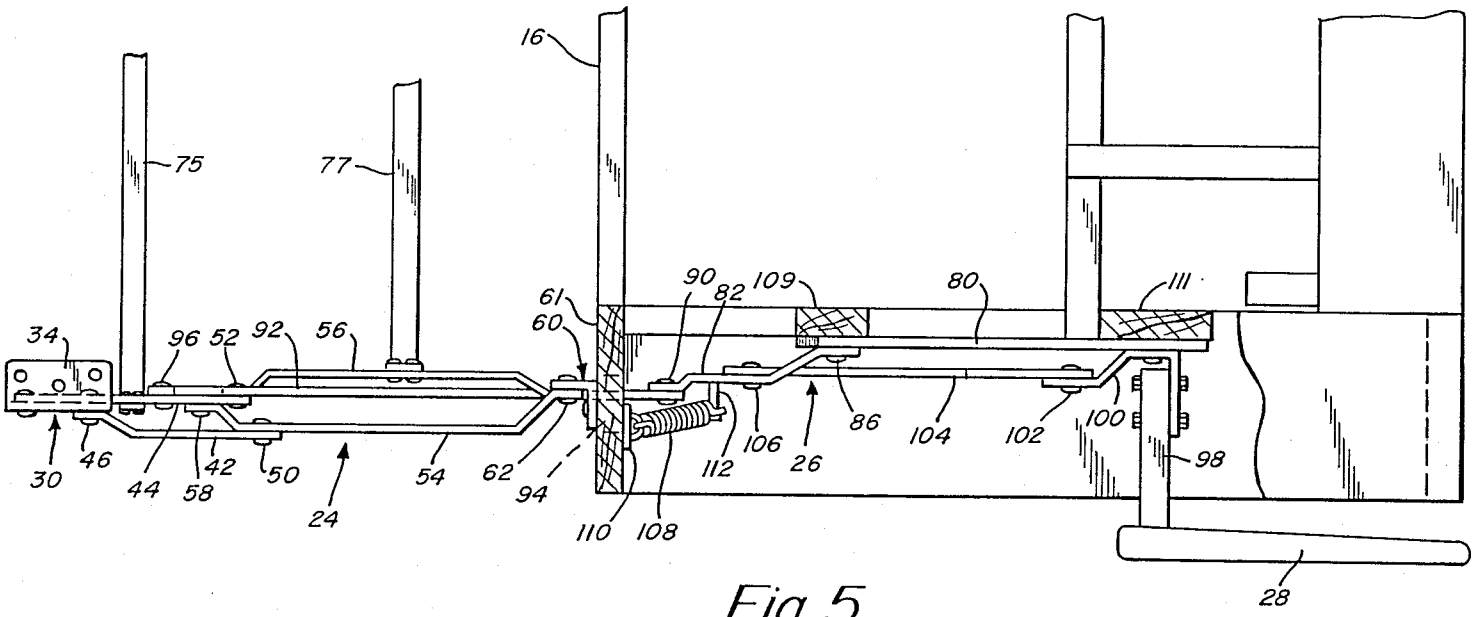
FIG. 5 is a fragmentary top view of a sofa frame showing the actuating mechanism of the assembly disposed within the arm of sofa frame.

The two lazy tong linkage mechanisms 24 are shown in FIGS. 1 and 5 to be joined by a pair of braces 75 and 77 that serve to stiffen the system, but do not add to the front to back thickness of the ottoman assembly 20.

Figure 2:
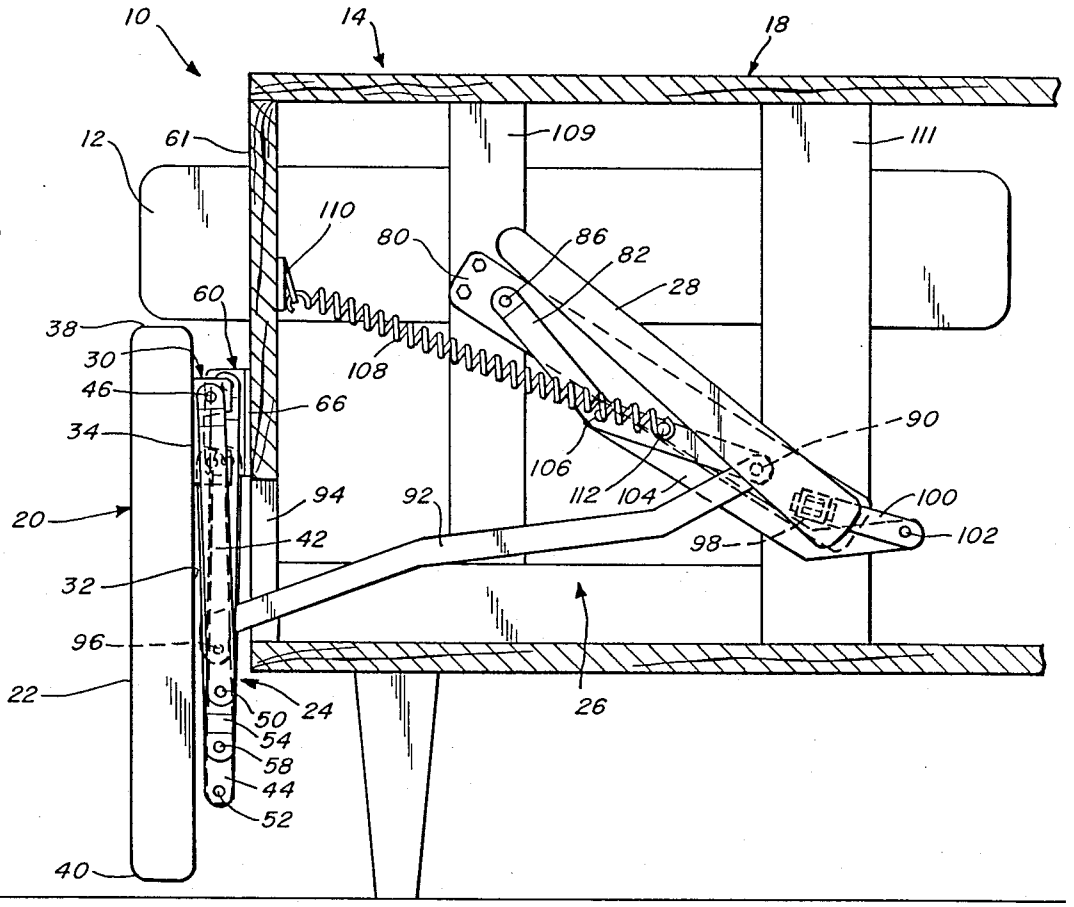
FIG. 2 is a fragmentary vertical cross-sectional view of the sofa frame shown in FIG. 1 with the ottoman assembly in the retracted position and the seat cushion added to the frame.
Figure 4:
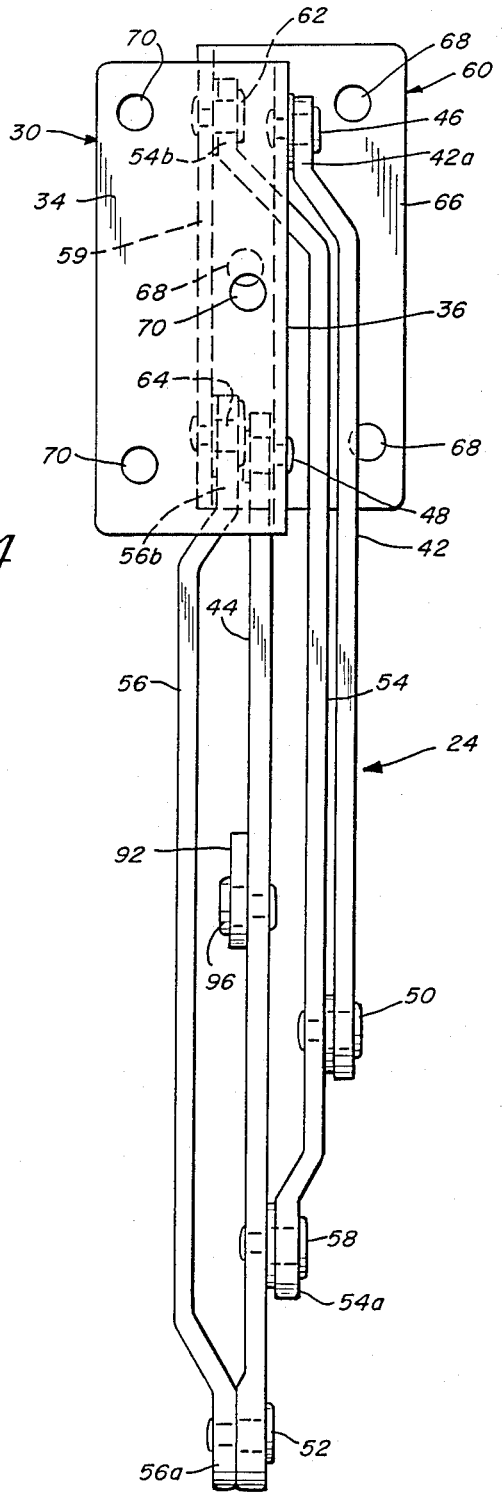
FIG. 4 is a front elevation view of the lazy tong linkage mechanism forming part of the ottoman assembly with the mechanism in position to support the ottoman in a retracted position.

When the lazy tong linkage mechanism 24 is collapsed as shown in FIGS. 2 and 4 to retract the ottoman 22, the flanges 36 and 59 of the brackets 30 and 60 in side profile overlap one another, the bracket plates 34 and 66 are close to one another in parallel planes, and the four levers 42, 44, 54 and 56 are disposed beside one another between the plates 34 and 66. In this fashion, the fore and aft dimension of the mechanism is minimized so as to support the ottoman very close to the front face of the front rail 16. The widths of the levers may be approximately ¾ inch, and the fore and aft dimension of the collapsed mechanism 24 including the brackets 30 and 60 may be 1½ inches.

Figure 3:
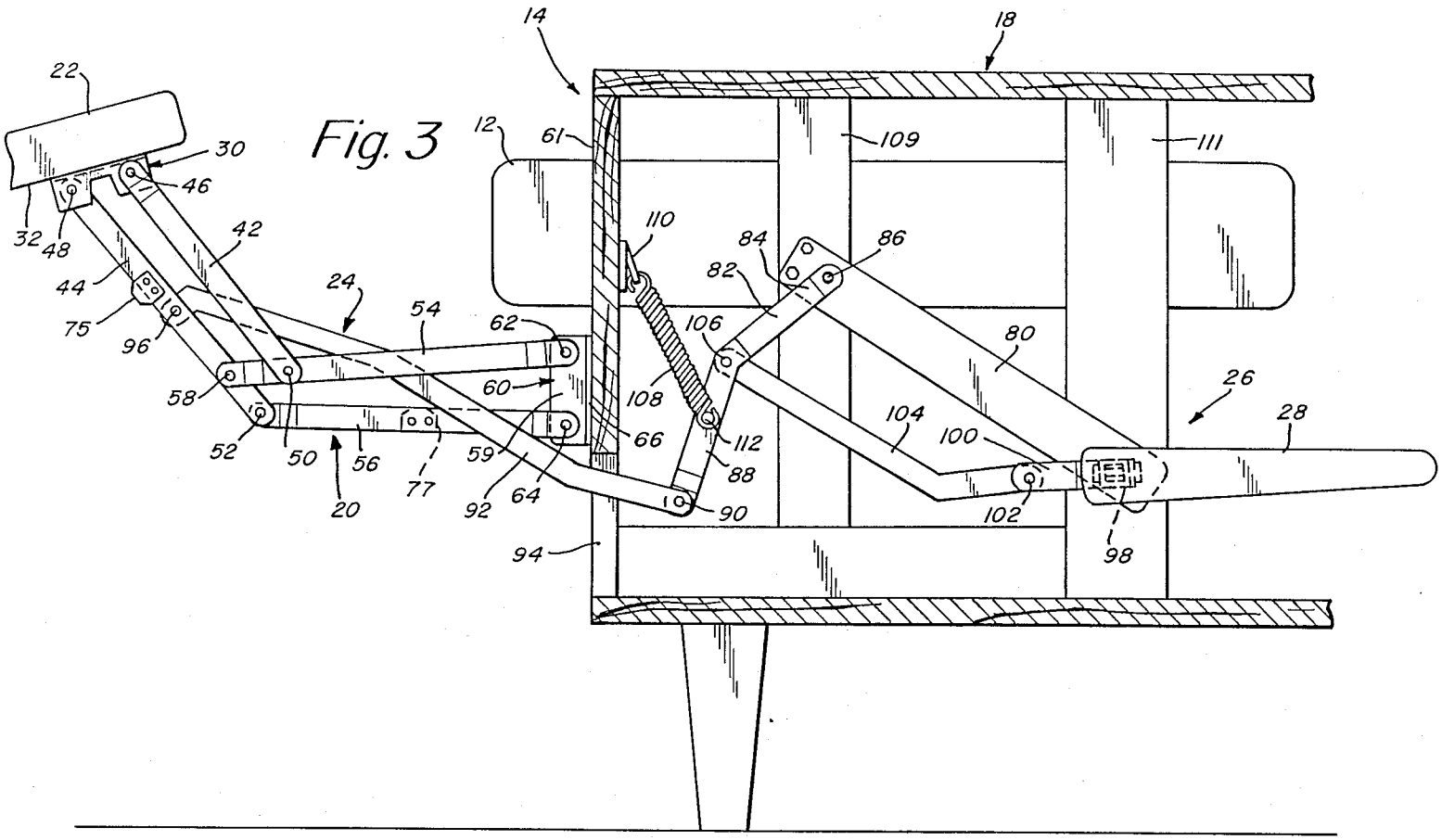
FIG. 3 is a fragmentary vertical cross-sectional view similar to FIG. 2 but showing the ottoman assembly in the extended position.

Actuating lever assembly 26 enables the party seated on the sofa to retract and extend the ottoman causing it to assume either of the positions shown in FIGS. 2 and 3. The ottoman may also be retracted by downward pressure applied to the ottoman surface by the occupant's legs. The actuating assembly as clearly shown in FIGS. 1 and 5 is mounted on a plate 80 which is bolted or otherwise secured inside the arm frame to the face of side frame 18. The plate is mounted so as to extend forwardly and upwardly on the frame 18. An actuating lever 82 is pivotally secured at its upper end 84 by pivot rivet 86 to the upper end of plate 80, and the other end 88 of the actuating lever 82 is secured by pivot rivet 90 to connecting link 92. The link 92 passes through a slot 94 in front rail 16 and extends forwardly from the lower end 88 of actuating lever 82 to the lever 44 of lazy tong mechanism 24 and is connected thereto by a pivot rivet 96.

Handle 28 is pivotally mounted on the lower end of plate 80 by shaft 98, and a link 100 also pivoted on the shaft 98 is fixed with respect to handle 28 so that rotation of the handle on the shaft 98 causes the link 100 to move with it. Link 100 in turn is connected by rivet 102 to a drive link 104, and the drive link is connected by a rivet 106 to the actuating lever 82 intermediate the ends thereof. The assembly is completed by a coil spring 108 which is secured at one end by bracket 110 to the back face of arm rail 61 which forms part of front rail 16 and at its other end by anchor 112 to the actuating lever 82 adjacent its lower end 88. The spring 108 serves to urge the ottoman assembly to each of the two extreme positions shown in FIGS. 2 and 3 as is explained more fully below.

In FIG. 5, it will be noted that the actuating lever 82, connecting link 92, link 100 and drive link 104 are all disposed within the arm frame outside the arm rails 109 and 111 and handle 28 is disposed outside the arm. The actuating mechanism 26 thus does not significantly reduce the space within the frame and does not impinge on the space normally occupied by a folding bed frame and mattress (not shown) in a sofa bed.

In FIG. 2, the ottoman is shown in its retracted position, and handle 28 extends upwardly and forwardly from shaft 98 on the plate 80 secured to the arm frame of the sofa. The handle ordinarily will be mounted on the outside of the arm, although it may be disposed on the inside of the arm adjacent the edge of the seat cushion 12. With handle 28 in the forward position, spring 108 is disposed over center with respect to the pivot rivet 106, and the spring thus serves to urge the actuating lever 82 to pivot in a counterclockwise direction about its rivet pivot 86. With the actuating lever 82 in that position, the connecting link 92 is withdrawn beneath seat cushion 12 and into the arm so that only its forward end extends through slot 94. This in turn retains the lazy tong mechanism 24 in a collapsed state so as to retract the ottoman 22 to a vertical position beneath the front edge of the seat cushion 12. When the occupant wishes to extend the ottoman 22 to the elevated position shown in FIG. 3, he or she need only pull rearwardly on the upper end of handle 28 so as to pivot it clockwise as viewed in the drawings on shaft 98. That action causes the link 100 to pivot clockwise on shaft 98 and push the drive link 104 to the left as viewed in FIGS. 2 and 3. The translational motion of the drive link 104 in turn causes the actuating lever 82 to pivot in a clockwise direction about its rivet pivot 86, which in turn moves the connecting link 96 forwardly so as to open the lazy tong linkage mechanism to the position of FIG. 3 and elevate the ottoman. It will be appreciated that when the rivet pivot 106 connecting the forward end of drive link 104 to lever 82 passes across the axis of spring 108, the spring will assist in pivoting the actuating link 82 clockwise so as to drive the connecting link 92 in a forward direction (left as viewed in the drawings) and hold the ottoman in its elevated position until it is again retracted.

From the foregoing description, it will be appreciated that the ottoman 22 is very easily actuated by means of the handle 28 so that the occupant of the sofa may move it between the retracted and extend positions without difficulty. The handle may be used to retract the ottoman, or the occupant need only apply downward leg pressure to retract it. The spring 108 assists in moving the ottoman and the related linkage mechanism to either of the extreme positions. It will also be appreciated that the ottoman assembly may be fabricated as a separate unit independent of the sofa, and the sofa manufacturer may readily incorporate the mechanism including the ottoman into the furniture at relatively little cost. The mechanism itself has a minimum number of parts, may be installed by a relatively unskilled mechanic, and is not costly.

Of particular importance is the fact that the ottoman assembly requires very little space in front of the front rail because of the very narrow side profile of the lazy tong linkage. Therefore, it is unnecessary to significantly increase the front to back dimension of the cushion 12, which would detract from the comfort of the sofa. And the actuating mechanism 26 which is very narrow may be mounted within the sofa arm or closely adjacent the arm frame so as not to subtract from the space within the frame which would be occupied by a folding bed frame and mattress in a sofa bed.

Having described this invention in detail, those skilled in the art will appreciate that numerous modifications may be made thereof without departing from the spirit of the invention. Therefore, it is not intended that the invention be limited to the single embodiment illustrated and described. Rather, it is intended that the scope of this invention be determined by the appended claims and their equivalents.

I claim:

1. A sofa ottoman assembly for mounting independently of the sofa seat comprising a first bracket adapted to be mounted on the front rail of a sofa below the front edge of the sofa seat cushion, said bracket including a flange disposed in a vertical plane perpendicular to the plane of the front rail;

a second bracket carrying an ottoman adapted to lie in a a vertical plane immediately in front of the front rail when the ottoman is retracted and in a generally horizontal plane at the approximate elevation of the seat cushion when the ottoman is extended, said second bracket having a flange extending vertically and perpendicular to the ottoman when the ottoman is retracted;

said first and second brackets also having plates lying substantially parallel to one another attached respectively in face to face relationship with the rail and ottoman when the ottoman is retracted, a lazy tong linkage interconnecting the flanges of the first and second brackets supporting the ottoman for movement between the retracted position immediately adjacent the front of a sofa and the extended position, said lazy tong linkage including a plurality of pairs of levers with each lever disposed in a separate plane and each separate from the planes of the flanges enabling the lazy tong linkage to be collapsed flat between the ottoman and front rail when the ottoman is retracted; and a handle operated lever assembly adapted to be mounted on the arm of the sofa and connected to the lazy tong linkage for actuating the linkage and moving the ottoman between the extend and retracted positions.

2. A sofa ottoman assembly as defined in claim 1 wherein said lever assembly included a mounting plate adapted to be mounted on an arm rail, a pair of levers connected between the lazy tong linkage and the mounting plate, a handle pivotally mounted on a shaft on the mounting plate, and a drive link connected between the pair of levers and the handle for driving the pair of levers to extend the ottoman.

3. A sofa ottoman assembly as defined in claim 2 wherein the pair of levers includes a first lever pivoted at one end to the mounting plate and pivoted at its other end to the second of the pair of levers, and means pivotally connecting the drive link to the first lever intermediate the ends of the first lever.

4. A sofa-bed comprising a frame having side arm rails, a front rail and a seat cushion, a pair of brackets secured to the front rail and each carrying a lazy tong linkage and an ottoman bracket, said brackets and lazy tong linkage lying entirely in front of the front rail, an ottoman mounted on the ottoman brackets and free of any connection to the seat cushion and its support, said ottoman adapted to lie in a vertical plane immediately in front of the front rail when the ottoman is retracted and in a generally horizontal plane at the approximate elevation of the seat cushion when the ottoman is extended, a mounting plate secured to a side arm rail and carrying a lever and a handle, a connecting link interconnecting the lever and the lazy tong linkage, and means including a drive link connected between the handle and the lever enabling operation of the handle to extend the ottoman.

5. A sofa as defined in claim 4 wherein the lazy tong linkage includes a plurality of levers all disposed in separate planes perpendicular to the front rail to provide a narrow side profile for the linkage.

6. A sofa as defined in claim 5 further comprising an over center coil spring connected between the frame and the lever for assisting movement of the ottoman to both the extended and retracted positions.

7. A sofa having an ottoman movable between extended and retracted positions comprising a sofa frame having a front rail, a first bracket having a plate mounted face to face on the front rail and a flange perpendicular to the front rail, a lazy tong linkage mechanism having a first pair of levers lying in separate planes and connected at their upper ends to the flange and disposed vertically one behind the other with reference to the ottoman in its retracted position, a second pair of levers as part of the lazy tong mechanism each lying in separate planes and separate from the planes of the first pair of levers, said second pair of levers connected at their low ends one each to one of the first pair of levers and disposed vertically one behind the other with reference to the ottoman in its retracted position, the levers of said first and second pairs of levers each having front and rear edges disposed vertically when the ottoman is retracted and all the levers being substantially co-extensive horizontally when measured from the front to the rear edges thereof with the ottoman retracted to minimize the distance between the planes of the front rail and retracted ottoman, a second bracket having a plate secured in face to face relationship with the ottoman and having a flange parallel to and spaced from the flange of the first bracket, and pivot means interconnecting the upper ends of the second pair of levers to the flange of the second bracket.

8. A sofa as defined in claim 7 wherein the two brackets are disposed at approximately the same height when the ottoman is retracted.

9. A sofa as defined in claim 7 wherein the four levers of the two pairs are aligned one behind the other when the mechanism is viewed from the side with the ottoman retracted.

* * * * *